United States Patent [19]

Grace

[11] Patent Number: 4,841,864

[45] Date of Patent: Jun. 27, 1989

[54] CONTROLLED EXPLOSIVELY FORMED PENETRATOR

[75] Inventor: Fred I. Grace, York, Pa.

[73] Assignee: The United States of America as represented by the Secretary of the Army, Washington, D.C.

[21] Appl. No.: 157,424

[22] Filed: Feb. 9, 1988

[51] Int. Cl.[4] ..... F42B 1/02

[52] U.S. Cl. ..... 102/307; 102/309; 102/476

[58] Field of Search ..... 102/306–310, 102/476

[56] References Cited

U.S. PATENT DOCUMENTS

| | | | |
|---|---|---|---|
| 3,176,613 | 4/1965 | Godfrey et al. | 102/24 |
| 4,080,898 | 3/1978 | Gieske | 102/24 |
| 4,359,943 | 11/1982 | Majerus | 102/309 |
| 4,466,353 | 8/1984 | Grace | 102/307 |
| 4,474,113 | 10/1984 | Kyro et al. | 102/306 |
| 4,499,830 | 2/1985 | Majerus et al. | 102/476 |
| 4,510,870 | 4/1985 | Walters | 102/307 |
| 4,543,703 | 10/1985 | Wetzel et al. | 102/310 X |

OTHER PUBLICATIONS

Hermann, Jr. et al., "Experimental and Analytical Investigation of Self Forging Fragments for the Defeat of Armor at Extremely Long Standoff", Presented at Third International Symposium on Ballistics, Karlsruhe, Germany, in Mar. 1977.

*Primary Examiner*—Peter A. Nelson

*Attorney, Agent, or Firm*—Saul Elbaum; Thomas E. McDonald; Guy M. Miller

[57] ABSTRACT

A method and apparatus for controlling the final shape of an explosively formed penetrator, in which a liner is explosively accelerated to high velocity to impact upon a mandrel and form a penetrator whose final shape, surface and mass distributions about its axis and along its length are determined by the mandrel shape. The shape of the mandrel can be varied to produce penetrators of optimal shape, depending upon the intended penetrator use. Such shape definition permits the dynamic formation of penetrators which have favorable static margins, which can be fin or spin stabilized, and which can have favorable shapes and mass distributions for effective target penetration.

19 Claims, 4 Drawing Sheets

CONTROLLED EXPLOSIVELY FORMED PENETRATOR

RIGHTS OF THE GOVERNMENT

The invention described herein may be manufactured, used or licensed by and for the United States Government for governmental purposes without the payment to me of any royalty thereon.

BACKGROUND OF THE INVENTION

The present invention relates to shaped charge explosive devices, and in particular, to a method and device for controlling the final shape of an explosively formed penetrator.

In the past, explosively formed penetrator devices have been limited in the sense that the final penetrator shape could only be controlled within the range of adjustable parameters concerning the explosive geometry, the liner geometry, and explosive initiation scheme. However, penetrators have been formed with shapes conforming roughly to spheroids and rods. Even there, the dynamic forming process created shot-to-shot variations in penetrator shapes together with gross imperfections. In reality, penetrator material was seldom disposed in compact form about the symmetry axis. Thus, hollow portions and mass variations existed along the penetrator length in the rod cause, and about a center point in the spheroidal case.

Also, some success has been obtained in producing aerodynamically stable penetrator shapes i.e., those formed with a drag flare. However, offsetting penalties, such as a rod length reduction and therefore penetration loss, have been experienced. Examples of rods formed with flares exhibited not only reduced length but also static margins which were barely acceptable.

The inability to produce further changes in mass distribution along the penetrator length also limits the penetration power of the penetrator. For certain penetration applications, a hollow or tubular penetrator shape is desired. Hollow penetrators have been formed by reducing the severity of liner flow toward the symmetry axis, the final cavity size being dependent upon the material's ability to absorb the energy involved to prevent further flow toward the axis. Since this is an asymptotic process, wide variations in the tube wall radius along the penetrator length resulted.

For solid body penetrators, more control of the velocity gradient and mass distribution over the penetrator length is desired. Limitations in explosives/metal geometry, and the nature of the dynamic forming process create wide variations in these parameters. Reducing the velocity gradient is not a solution as it has the effect of producing reduced final penetrator length. Increasing penetrator length using high velocity gradients along the penetrator length causes excessive stretching which results in penetrator breakup.

SUMMARY OF THE INVENTION

It is a primary object of the invention to provide a method and apparatus for producing penetrators with improved aerodynamics and penetration properties.

The present invention includes an explosive section having a metallic liner in contact with the explosive, together with a mandrel which is placed in front of the liner. During the dynamic forming process, the liner material flow is influenced by the presence of the mandrel, causing the forming penetrator to take on the mandrel's shape. By proper mandrel geometry, it is possible to produce penetrators with various shapes, and to control the shapes to dimensional tolerances not possible in the past. Included are tubular projectiles with fixed geometry, solid penetrators with controlled mass and velocity distributions along the length, projectiles with drag flares or fins, and projectiles with spin for aerodynamic stability. The ability to control the projectile shape, velocity gradients, and length provide high penetrator stability and accuracy, as well as penetration.

BRIEF DESCRIPTION OF THE DRAWINGS

The invention will be better understood, and further objects, features, and advantages thereof will become more apparent from the following description of preferred embodiments, taken in conjunction with the following drawings in which.

DESCRIPTION OF THE PREFERRED EMBODIMENTS

Figure 1:
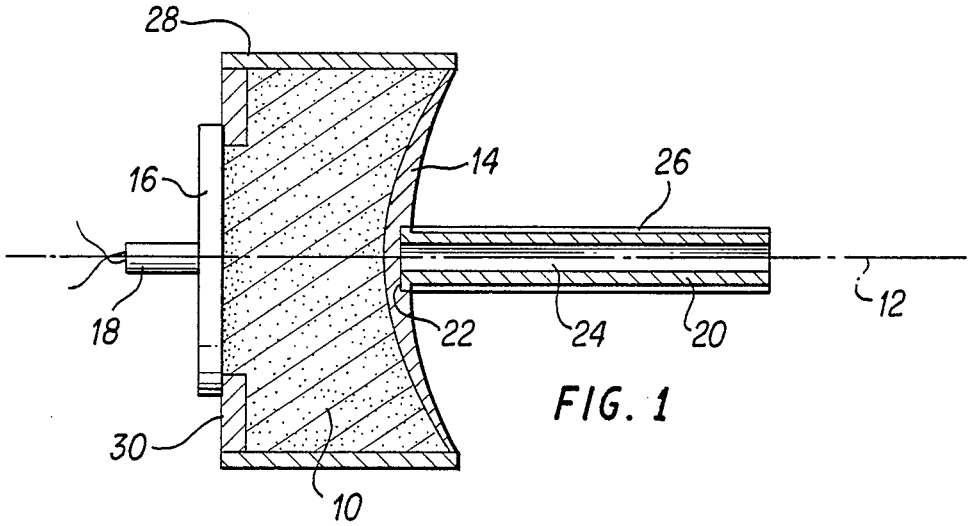
FIG. 1 is a cross sectional side view of a first embodiment of the invention, taken along line 1—1 of FIG. 2.
Figure 2:
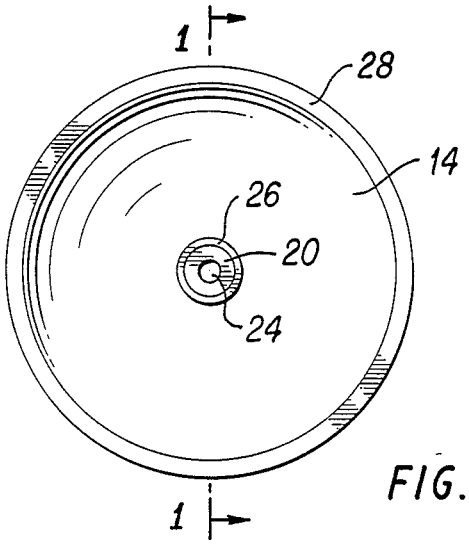
FIG. 2 is a front view of the embodiment shown in FIG. 1.

The embodiment of the invention shown in FIG. 1 includes an explosive section 10 disposed on an axis of symmetry 12. A metallic liner 14 is disposed on axis 12 at a front side of the explosive section 10. An initiation device 16 for the explosive section 10 is disposed at a back side of the explosive section 10. A detonator 18 is utilized to initiate the explosive contained in the initiation device 6. A mandrel 20 which extends symmetrically about and along the axis 12, has a back end 22 attached to the liner 14. The mandrel has a hollow cavity 24, which can be filled with material or ambient air. A sheath 26 is disposed about the mandrel 20. A metallic casing 28 surrounds the explosive section 10. A metallic plate 30 covers the explosive section 10 and holds the initiation device 16.

The purpose of the explosive section 10 is to provide energy required to accelerate the metallic liner 14 to high velocity along the charge axis 12. The metallic casing 28 and the metallic plate 30 provide confinement of the detonation explosive gas pressure. The metallic plate 30 also holds the initiator device 16 in place. The shape of the explosive section 10 does not have to be cylindrical, as shown in FIG. 1, but can have a tapered longitudinal section along its length.

The purpose of the metallic liner 14 is to be accelerated by the detonating explosive along the charge axis 12 while being folded inward to produce a formed penetrator with net motion along the axis 12. The metallic liner 14 will generally have a free surface away from the explosive section 10, whose curvature is concave when viewed from a point along the axis 12 on the opposite side of the explosive section 10. The thickness of the metallic liner 14 will generally vary with radial position from the axis 12. The choice of the liner materials depends upon the particular target to be penetrated. For example, liner materials which have been used in the past include copper, nickel, aluminum, steel, tantalum, and beryllium.

The function of the mandrel 20 is to create a surface upon which the accelerated liner can form. In the embodiment of FIG. 1, the mandrel 20 is cylindrical in shape, in order to form a tubular penetrator. The mandrel can be tapered or curved along its length to form penetrators of other shapes, as described in further detail below.

However, in each case, the mandrel will have a cross sectional area which does not increase at any point along its length from its back end to its front end so that the penetrator formed about the mandrel can retain its shape while moving over and beyond the mandrel in a forward direction along the charge axis 12.

Figure 3:
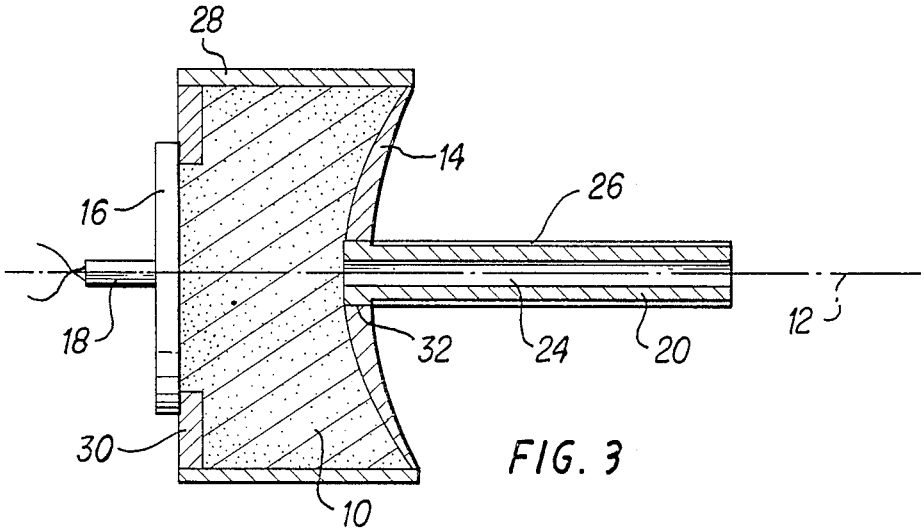
FIG. 3 is a cross-sectional side view of a variation in the embodiment of FIG. 1.
Figure 4A:
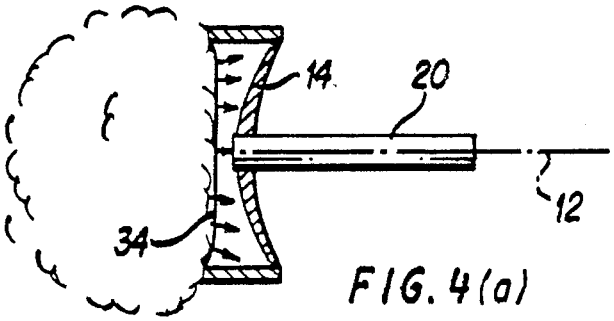
FIG. 4, at (*a*), (*b*), (*c*), and (*d*), shows the progresive collapse of the liner in the embodiment of FIG. 3.
Figure 4B:
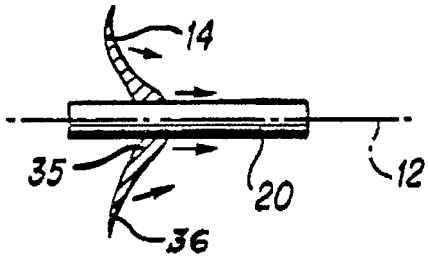
Figure 4C:
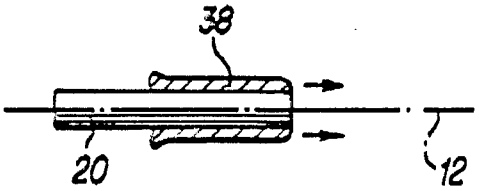
Figure 4D:
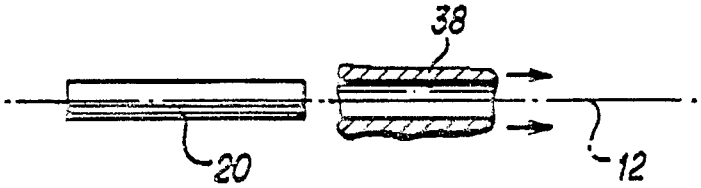

In FIG. 1, the mandrel 20 is formed as a tube filled with ambient air. However, the mandrel 20 can also be solid or filled with an energy absorbing material. For example, the mandrel may be formed of thin walled steel tubing having an inner core of porous metal, such as sintered copper, to absorb excess impact energy when the accelerated liner 14 strikes the mandrel. The mandrel 20 can be attached to the liner 14 in various ways. For example, it may have a flat butting end 22 joined with a flat impression prepared in the liner 14 central surface, as shown in FIG. 1, or it can be fitted into a central opening 32 of the liner 14, as shown in FIG. 3. Actually, it is not necessary that the mandrel 20 be in contract with the liner 14, although it must be in close proximity to the liner 14 to perform its function. Thus, the mandrel 20 could extend through the liner 14 and the explosive element 10 and be affixed to the rear plate 30. However, securing the mandrel 20 to the liner 14 is probably the simplest and most convenient way of correctly positioning the mandrel 20 along the axis 12.

When the mandrel 20 is disposed in front of a solid liner 14 and the liner 14 is accelerated by the explosive element 10, the axial center portion of the liner 14 is restrained by the rear end 22 of the mandrel 20 while the remainder of the liner 14 is broken away and accelerated in the forward axial direction. To assure that this break occurs uniformly about the circumference of the mandrel end 22, the flat impression in the liner 14 for receiving the mandrel end 22 may be recessed, as shown in FIG. 1. Another way of accomplishing the same result would be to form the liner 14 with an annular axial groove on either or both sides of the liner coinciding with the circumference of the mandrel end 22.

The mandrel 20 may include a sheath 26 of varied material density to absorb any excess impact energy during collision between the metallic liner 14 and the mandrel 20. For example, this sheath may be composed of porous metallic material or resilient plastic material. Thus, various materials of different densities can be used for the mandrel 20, so long as this interaction with the moving liner 14 produces the desired penetrator shape.

Referring now to FIG. 4, in operation, the detonator 18 produces a single point initiation of the initiator 16 explosive. The initiator 16 provides point, annular, or planar initiation of the main explosive charge 10, depending on the type and shape of detonation wave 34 desired. The detonation wave 34 starts at the initiator/-main explosive charge interface and sweeps towards the metallic liner 14, as shown in FIG. 4(*a*). When the detonation wave reaches the metallic liner 14, the action of the explosive energy accelerates the liner forward, as shown in FIG. 4(*b*). At the same time, the liner is accelerated slightly toward the axis 12. The relationship between forward and inward velocities can be adjusted by the liner thicknesses and curvatures such that either a "forward" folding or "rearward" folding process can be obtained. In the first case, the inward portion of the liner 14, in time, lags behind the outer liner portion. In the second cse, illustrated in FIG. 4(*b*), the inward portion 35 of the liner 14, in time, leads the outer liner portion 36. In either case, however, the liner 14 tends towards the axis 12 forming the desired tubular penetrator 38. The mandrel 20 restricts the amount of radial motion which can be obtained by the liner 14, since impact of the liner 14 and the mandrel 20 will occur at the mandrel's outer surface. Under some conditions, the impact velocity of the liner 14 can be sufficiently high so as to create shock reflection and rebound of the liner 14 from the mandrel surface. However, the sheath 26 of dissimilar material together with suitable choices of mandrel wall thickness and filler material can alleviate such rebound. For example, the sheath 26 may be a porous metal tube, such as sintered copper or copper alloy, to absorb impact energy directed radially inward. Also, the sheath 26 can be made of a resilient plastic material such as polyethylene, which not only absorbs excess impact energy during the collision of the liner and mandrel, but also minimizes friction between the explosively formed tubular penetrator 38 and the mandrel, so that the tubular penetrator 38 is easily accelerated along and past the mandrel 20, as shown in FIGS. 4(*c*) and (*d*). Also, the sheath 26 can have multiple layers, such as an outer plastic layer to reduce friction, and a inner porous metal layer to absorb excess impact energy.

The mandrel 20 for producing a tubular projectile does not need to have a cylindrical outer surface. For example, the mandrel 20 may have an oval, triangular, rectangular, or star-shaped cross section to produce a tubular penetrator having an oval, triangular, rectangular, or star-shaped cross section, respectively.

Figure 5:
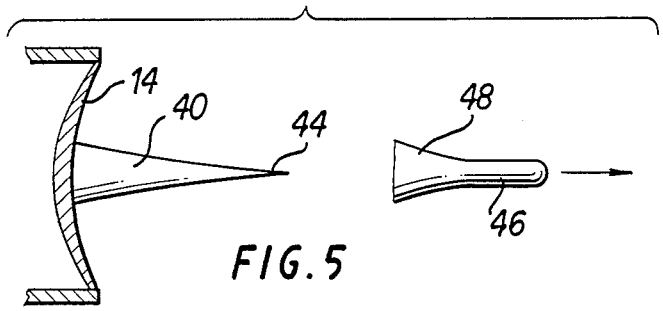
FIG. 5 is a cross-sectional side view of a second embodiment of the invention, taken along line 5—5 of FIG. 6, and also showing a side view of the final penetrator formed by this embodiment.
Figure 6:
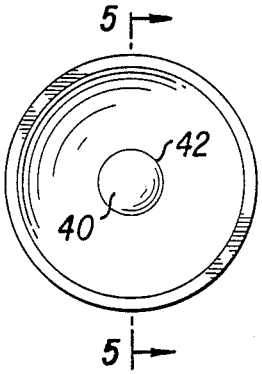
FIG. 6 is a front view of the embodiment of FIG. 5.
Figure 7:
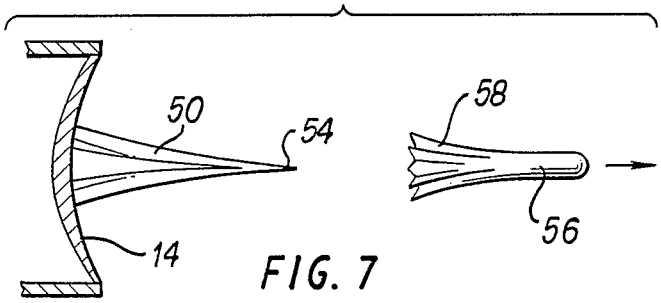
FIG. 7 is a cross-sectional side view of a third embodiment of the invention, taken along line 7—7 of FIG. 8, and also a side view of the penetrator formed by this embodiment.
Figure 8:
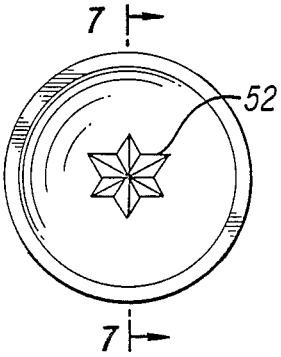
FIG. 8 is a front view of the embodiment of FIG. 7.
Figure 9:
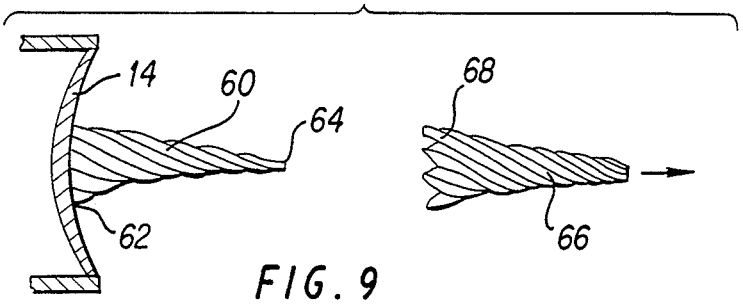
FIG. 9 is a cross-sectional view of a fourth embodiment of the invention; which also shows a side view of the penetrator formed by this embodiment.

Using the same principles as described above, solid penetrators of various shapes can be obtained by utilizing tapered or pointed mandrels. For example, the embodiment of the invention shown in FIGS. 5 and 6 utilizes a curved and pointed mandrel 40 having a circular cross section which varies along its length from a maximum 42 adjacent the liner 14 to a pointed mandrel end 44, for producing a solid penetrator 46 having a flared rear portion 48. The embodiment shown in FIGS. 7 and 8 utilizes a curved and pointed mandrel 50 having a star-shaped cross section which varies along the length of the mandrel from a maximum 52 adjacent the liner 14 to a forward point 54 of the mandrel 50, for producing a solid penetrator 56 having a finned back section 58. The embodiment of the invention shown in FIG. 9 includes a starred and spiraled tapered mandrel 60 having a star-shaped cross section which is varied and rotated along the length of the mandrel from a maximum 62 adjacent the liner 14 to a pointed end 64 of the mandrel 60. This mandrel produces a penetrator 66 with spiralled fins 68 extending along its length.

Using the general principle of forming the penetrator by impacting the liner upon a mandrel, it is seen that a great variety of various shaped penetrators can be produced, all depending on the cross-sectional and longitudinal shapes of the mandrels utilized. Various combinations of mandrel and liner geometry can be utilized to create penetrators whose solid portions and hollow portions can be disposed along the penetrator length as a means to advantageously redistribute the mass and effective surface areas for aerodynamic stability. In similar fashion, mass and shape can be distributed for advantageous penetration of complex armor arrays.

All of these various mandrels, such as those shown in FIGS. 5–9, can be constructed of a solid material such as steel, or can be of hollow construction filled with ambient air or a variable-density impact-absorbing material. Also, all of these embodiments may include a sheath of similar construction of the sheath 26 described above, for absorbing excess impact energy to prevent liner rebound and/or to minimize friction between the forming penetrator and the mandrel.

RELATION OF PENETRATOR SHAPE TO PENETRATOR FUNCTION

The general problems regarding explosively formed penetrators are those of aerodynamic stability and terminal ballistics. For explosively formed penetrator devices used at short stand-offs of 10 meters or less the only problem is one of terminal ballistics. At greater stand-offs, for a penetrator having a length L to diameter D ratio greater than 1 (L/D>1), the projectile may become aerodynamically unstable causing projectile tumble and increased drag. This leads to higher velocity losses and improper impact orientation, all of which reduces the penetrating power of the penetrator. Further, there are applications that require a tubular or hollow penetrator. In this case, it is highly desirable to form a right circular tube as opposed to a conical hollow tube, for maximum penetration. Examples of these considerations follow.

One of the ways proposed to increase static margin is to redistribute the mass and surface area in the final formed penetrator, as well as change its shape. Using prior art without a mandrel, the problem is difficult since the final mass distribution depends upon the explosive/liner geometry which cannot be varied much else proper rod penetrator formation cannot take place. Usually when adjustments are made to redistribute the rod mass along its length, improper velocity gradients are introduced. If too high, the resultant rod breaks up during formation, i.e., the projectile pulls itself apart. If too low, a short rod is formed. The surface contour also varies with the mass distribution. Generally, attempts have been made to create a tapered hollow region at the projectile rear to generate a flare. Little control over the geometry of the flared area has been achieved. The approach relies on the material strength to arrest the radial motion at a precise distance from the axis. This is particularly difficult under highly dynamic flow conditions. Further, in general, more mass is contained in the flared section, since the flare is formed from outer radial liner sections and also thick material sections are required for the total material strength to be useful in the arresting process. This results in a formed rod with high surface area at the rear (desirable) and high mass at the rear (undesirable). A mandrel such as described herein, permits the use of thinner liner sections which ultimately make up the flare. The mandrel both resists (stops) the radial motion (absorbs the radial energy) and does so at a predetermined radius. This eliminates high mass at the projectile rear and provides a well defined surface. A typical penetrator 70, shown in FIG. 10(*a*), would have L/D=3 of which the final one-third is utilized as a flare. Having uniform mass distributed along the length with a flare of 30° provides a static margin of 0.10 for example. In this case, the hollow (tapered) portion contributes nothing to the penetration, therefore the penetration is proportioned to the length. Thus the penetration P of the penetrator 60 is given by $$P=\gamma\tfrac{2}{3}L$$

where $\gamma$ is a proportionality constant. The static margin M is given by $$M=0.1L.$$

Figure 10:
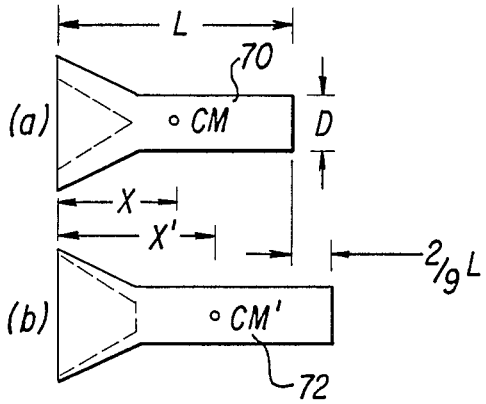
FIG. 10 shows two simplified schematic side views of explosively formed penetrators, for comparing a conventional flared penetrator with a flared penetrator formed in accordance with the present invention.

The mandrel technique allows the mass to be redistributed so that the tapered section contains only one-third of its previous mass, or one-ninth of the projectile mass. The remaining two-ninths mass can be redistributed into penetrator length as shown in FIG. 10(*b*), so that the new penetrator 72 has penetration of:

$$P'=P+\gamma(2/9)L=\gamma\tfrac{1}{2}L+\gamma(2/9)L=\gamma(8/9)L.$$

The ratio is:

$$(P'/P)=1.33$$

or 33% improvement. From before, the static margin gains from a center of mass shift only, in this simple case, since any effect of the two-ninths length increase on the center of pressure has been neglected. The old center of mass CM was located at $X=\tfrac{1}{2}L$ while the new center of mass CM′ is located at:

$$X'\simeq\tfrac{1}{2}(L+(2/9)L).$$

The difference in new and old centers of mass is 2/9 L. Now the new static margin M′ is:

$$M'=M+(2/9)L$$

$$M'=0.1L+(2/9)L=0.1L+0.22L$$

$$M'=0.33L.$$

In this case the static margin has improved by 330%.

The spin of a projectile can provide two advantages. In one case, if the projectile is drag stabilized, the small amount of spin can be used to cancel out asymmetries in the projectile body to provide much higher accuracy. This is extremely important in an explosively formed penetrator where the dynamic formation lacks precision. In the second case, the projectile is spun at high rates, 300 Hz, for spin stabilization. Current methods require the spin to be acquired during the penetrator formation process. The most common method is use of a fluted liner so that impact of the detonation forces induces an angular velocity in addition to the longitudinal and radial velocity components otherwise required. The flutes further complicate the penetrator formation process. Use of a mandrel having a star shaped cross section and a spiraled longitudinal section allow a non-fluted or axisymmetric liner to be used since the penetrator does not acquire its rotational energy until it has impacted and formed over the mandrel. Further, since the penetrator outer surface exhibits this spiral feature, rotation will continue during flight. There are no quantitative measures of improvement in projectile performance at this time.

Figure 11:
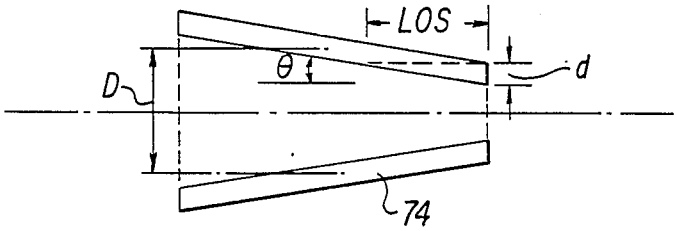
FIG. 11 is a simplified cross-sectional view of a penetrator having the form of a hollow, truncated cone.

General experience indicates that when a hollow or tubular projectile is formed using previous methods, little control of the final cavity is achieved. Shot-to-shot variations appear to show that deviations from the ideal cylindrical shell shape would be as high as ±10 degrees, thus often hollow conical sections are formed rather than tubes. Further, for those near cylindrical shape there are sinusoidal wall deflections along the projectile length. This reduces the line of sight material column length which contributes to the penetration. Penetration of an ideal tube (or rod), all else being equal, is proportional to the length of the rod. If the wall of the the tube is not collinear, a penetration loss will result. Obviously, a conical tube would lose penetration. A penetrator of $L/D=3$, a conical tube 74 of $2\theta$ included angle ($\theta$ half angle) and wall thickness d of 1 mm would have a line of sight penetration, LOS, capability as shown in FIG. 11. LOS is given by $$\tan\theta=(d/\mathrm{LOS})$$

or $$\mathrm{LOS}=d/\tan\theta, \mathrm{LOS}<D.$$

The angle at which the LOS is reduced to one-half the total rod length occurs at $\mathrm{LOS}=D/2$.

$$\theta = \arctan\left(\frac{d}{D/2}\right)$$

$$\theta = \arctan\left(\frac{2d}{D}\right)$$

Assuming that the wall thickness is ½ D then $$\theta=\arctan(2d/8d)=\arctan(0.25)$$

$$\theta\simeq 14 \text{ degrees.}$$

Thus a deviation of $\theta=14$ degrees results in a penetration loss of 50%.

There are many variations, modifications, and additions to the invention which would be obvious to one skilled in the art. Therefore, it is intended that the scope of the invention be limited only by the appended claims.

What is claimed and desired to be secured by Letters Patent of the United States is:

1. Apparatus for explosively forming a penetrator, comprising:

an axis;

a metallic liner having a front side and a back side, said liner extending symmetrically about said axis and being concave in shape as viewed from the front side of the liner;

explosive means, disposed at the back side of the liner, for accelerating the liner in a forward axial direction and in an inward radial direction so that an outer portion of the liner is folded inwardly toward the axis to form said penetrator having net motion along the axis; and mandrel means including an outer surface extending symmetrically about and along the axis in front of the liner so that the liner being accelerated and folded by the explosive means impacts upon said outer surface of the mandrel means to form the penetrator.

2. Apparatus for explosively forming a penetrator, comprising:

an axis;

a metallic liner having a front side and a back side, said liner extending symmetrically about said axis and being concave in shape as viewed from the front side of the liner;

explosive means, disposed at the back side of the liner, for accelerating the liner in a forward axial direction and in an inward radial direction so that an outer portion of the liner is folded inwardly toward the axis to form said penetrator having net motion along the axis; and mandrel means including an outer surface extending symmetrically about and along the axis in front of the liner so that the liner being accelerated and folded by the explosive means impacts upon said outer surface of the mandrel means to form the penetrator, wherein said mandrel mean comprises energy absorbing means for reducing outward rebound of the liner impacting upon the outer surface of the mandrel means.

3. Apparatus, as described in claim 2, wherein said mandrel means comprises an inner element of metallic material and said energy absorbing means comprises a sheath of dissimilar material disposed about said inner element and forming the outer surface of the mandrel means.

4. Apparatus, as described in claim 3, where said sheath comprises porous metallic material.

5. Apparatus, as described in claim 3, wherein said sheath comprises a resilient plastic material.

6. Apparatus, as described in claim 3, wherein said inner element is a solid metal element.

7. Apparatus, as described in claim 3, wherein the inner element of the mandrel mean comprises an outer wall defining an axially-extending hollow space therein.

8. Apparatus, as described in claim 1, wherein the mandrel means comprises a hollow metallic element forming the outer surface of the mandrel means.

9. Apparatus, as described in claim 8, wherein the hollow metallic element of the mandrel means is filled with an energy absorbing material.

10. Apparatus, as described in claim 1, wherein the outer surface of the mandrel means is cylindrical in shape, to form a cylindrical penetrator.

11. Apparatus, as described in claim 1, wherein the outer surface of the mandrel means is tapered inwardly in a forward direction to a point on the axis so as to form a flared penetrator having a solid front end.

12. Apparatus, as described in claim 1, wherein the outer surface of the mandrel means has a cross section in the shape of a regular polyhedron.

13. Apparatus, as described in claim 12, wherein said regular polyhedron is a star shape.

14. Apparatus, as described in claim 13, wherein the outer surface of the mandrel means is tapered from the liner to a point on the axis, the star-shaped cross section decreasing in size along the axis from the liner to said point, so as to form a finned penetrator having a solid front end.

15. Apparatus, as described in claim 14, wherein the star-shaped cross section of the mandrel means outer surface is rotated along the axis from the liner to said point, so as to form a spiral finned penetrator having a solid front end and to induce rotational spin in the final penetrator characteristics.

16. Apparatus, as described in claim 1, wherein said mandrel means is affixed to a center portion of the liner.

17. Apparatus, as described in claim 16, wherein a back end of the mandrel means extends through a center opening of the liner.

18. A method for controlling the final shape of an explosively formed penetrator traveling in a forward direction along a charge axis, the penetrator being formed from a metallic liner which is symmetrically disposed about the axis and which is concave in shape as viewed from a front side of the liner, the liner being explosively accelerated in a forward axial direction and in an inward radial direction so that an outer portion of the liner is folded inwardly toward the axis to form the penetrator, wherein the method comprises the step of:

restricting the inward radial motion of the liner being accelerated and folded by symmetrically disposing a mandrel along and about the axis so that at least a portion of the liner is forced to flow over the mandrel, whereby the shape of the mandrel determines the final shape of the penetrator, the mandrel having a cross sectional area which does not increase at any point along its length between a back end and a front end so that the penetrator formed about the mandrel can retain its shape while moving over and beyond the maandrel in the forward direction along the charge axis.

19. A method, as described in claim 18, wherein the mandrel comprises energy absorbing material and wherein the method comprises the further step of:

absorbing excess impact energy during collision between the liner and the mandrel to reduce outward rebound of the liner impacting upon the mandrel.

* * * * *